US006308717B1

(12) United States Patent
Vrtaric

(10) Patent No.: US 6,308,717 B1
(45) Date of Patent: Oct. 30, 2001

(54) HAIR BRUSH WITH MOVABLE BRISTLES

(76) Inventor: John Vrtaric, 580 Amboy Ave., Woodbridge, NJ (US) 07095

( * ) Notice: Subject to any disclaimer, the term of this patent is extended or adjusted under 35 U.S.C. 154(b) by 0 days.

(21) Appl. No.: 09/617,247

(22) Filed: Jul. 14, 2000

(51) Int. Cl.[7] ..... A45D 24/04

(52) U.S. Cl. ..... 132/200; 132/129; 132/161; 132/142

(58) Field of Search ..... 132/161, 107, 132/126, 127, 128, 129, 136, 151, 271, 272, 141, 158; 15/159.1, 160, 172, 201, DIG. 5, 142

(56) References Cited

U.S. PATENT DOCUMENTS 1,621,269 * 3/1927 Pickford ..... 132/142
2,685,292 * 8/1954 Staiano ..... 132/120
3,172,139 * 3/1965 Wire ..... 15/160
4,008,726 * 2/1977 DiGiuseppe ..... 132/136
4,030,158 * 6/1977 Blair et al. ..... 15/207.2
4,475,563 * 10/1984 Martin ..... 132/136
5,657,775 * 8/1997 Chou ..... 132/125
5,715,847 * 2/1998 Rolf et al. ..... 132/271
5,894,849 * 4/1999 Ehlhardt et al. ..... 132/271

* cited by examiner

*Primary Examiner*—Todd E. Manahan
*Assistant Examiner*—David Comstock
(74) *Attorney, Agent, or Firm*—Ezra Sutton

(57) ABSTRACT

A hair brush for multi-purpose hair styling and hair grooming. The hair brush includes a brush housing having an outer stationary frame section having short bristles thereon and an inner movable frame section having long bristles thereon; and a handle section attached to one end of the brush housing. A plurality of connecting springs are used for movably connecting the inner movable frame section to the outer stationary frame section. A slide button member is used for pushing the inner movable frame section from a first position to a second position. The inner movable frame section is movable between the first position and the second position to repeatedly move the inner movable frame section in a forward and reverse direction relative to the outer stationary frame section such that the long bristles operate to move the user's hair laterally relative to the direction of movement.

14 Claims, 5 Drawing Sheets

HAIR BRUSH WITH MOVABLE BRISTLES

FIELD OF THE INVENTION

This invention relates to a hair brush with movable bristles for grooming and styling hair. More particularly, the hair brush is multi-functional in operation in having movable long bristles relative to stationary short bristles, wherein the movable long bristles brush the lower layer of the user's hair to the left and right in order to cover thin, balding and/or parted hair, and the stationary short bristles brush the upper layer of the user's hair straight back.

BACKGROUND OF THE INVENTION

Hair styling with hair brushes and combs is well known in the art. Hair brushes of various designs and configurations usually provide a specific type of hair styling to the user's hair with regard to the general contours and the body of the hair wanted by the user. Such styling includes layering of the hair, curling the hair, adding volume to the hair, parting the hair and the like. Usually, the user needs a different type of hair brush for producing a particular type of hair style, as previously mentioned.

There remains a need for a hair brush with movable bristles to provide multi-purpose hair styling and hair grooming use wherein the hair brush can perform different types of hair styling with the same brush. This hair brush would include movable long bristles relative to stationary short bristles such that the long bristles are movable in a horizontal position in the same plane in order to create different styles and layering of the user's hair.

DESCRIPTION OF THE PRIOR ART

Hair brushes with movable bristle rows having various designs, configurations, structures, functionality, and materials of construction have been disclosed in the prior art. For example, U.S. Pat. No. 4,475,563 to MARTIN discloses a blow dryer brush having rows of bristles that are movable with respect to each other in a one-dimension direction (laterally) , which enables the user in placing of waves and curls in the hair. The brush has a handle portion and a bristle carrier portion. The bristle carrier portion is divided into at least two sections, one stationary and one movable. Each section contains bristles for engaging hair. The movable section is movable with respect to the stationary section. This allows one to engage the hair in a first position, then shift the movable section to the second position. Engaged hair will form a curve between the portion that remains with the stationary section and the portion that remains with the movable section. Hot air from the blower discharged through apertures in the sections dries the hair in the desired position. This prior art patent does not disclose or teach the design, structure and function of the present invention.

U.S. Pat. No. 4,225,997 to THOMAS et al discloses a self-cleaning hair brush in which the bristles of the brush can be retracted within apertures formed through the anterior wall of the brush to remove foreign materials such as hair, debris and dandruff; and the bristles can be readily held in place when the hair brush is in use for normal hair brushing purposes. This prior art patent does not disclose or teach the design, structure and function of the present invention.

U.S. Pat. No. 4,987,633 to HENEVELD discloses a compact portable brush having a handle which is collapsed to reduce the size of the brush when carried by the user. The handle extends from the housing such that the brush bristles are interconnected with the bristle support means to cause the bristles to be retracted into the housing when the handle is collapsed in the compact, carry position. This prior art patent does not disclose or teach the design, structure and function of the present invention.

None of the aforementioned prior art patents teach or disclose a hair brush with movable long bristles relative to stationary short bristles for multi-purpose hair styling and hair grooming use on an individual's hair as shown in the present invention.

Accordingly, the object of the present invention is to provide a hair brush with movable bristles that is multi-functional in hair grooming and styling.

Another object of the present invention is to provide a hair brush with movable bristles, wherein the long bristles of the hair brush are movable relative to the stationary short bristles within the same hair brush.

Another object of the present invention is to provide a hair brush with movable bristles, wherein the movable long bristles being set in the moved position style the user's hair by brushing the lower layer of the user's hair to the left and right in order to cover thin, balding and/or parted hair.

Another object of the present invention is to provide a hair brush with movable bristles, wherein the stationary short bristles style the user's hair by brushing the upper layer of the user's hair straight back.

Another object of the present invention is to provide a hair brush with movable bristles, wherein the unmoved long bristles and the stationary short bristles in this first position style the user's hair by brushing back all layers of the user's hair in order to add more volume to the brushed hair of the user.

Another object of the present invention is to provide a hair brush with movable bristles, wherein the movable bristles are used for back combing and/or teasing the hair in order to add more volume to the brushed hair of the user.

Another object of the present invention is to provide a hair brush with movable bristles that is made from moldable polypropylene plastic in a one-step molding process.

A further object of the present invention is to provide a hair brush with movable bristles that can be mass produced in an automated and economical manner and is readily affordable by the user.

SUMMARY OF THE INVENTION

In accordance with the present invention, there is provided a hair brush for multi-purpose hair styling and hair grooming. The hair brush includes a brush housing having an outer stationary frame section having short bristles thereon and an inner movable frame section having long bristles thereon; and a handle section attached to one end of the brush housing. A plurality of connecting springs are used for movably connecting the inner movable frame section to the outer stationary frame section.

A slide member is used for repeatedly moving the inner movable frame section from a first position to a second position. The inner movable frame section is movable between the first position and the second position in order to move the inner movable frame section in a forward and reverse direction relative to the outer stationary frame section such that the long bristles operate to move the user's hair perpendicularly relative to the direction of movement.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
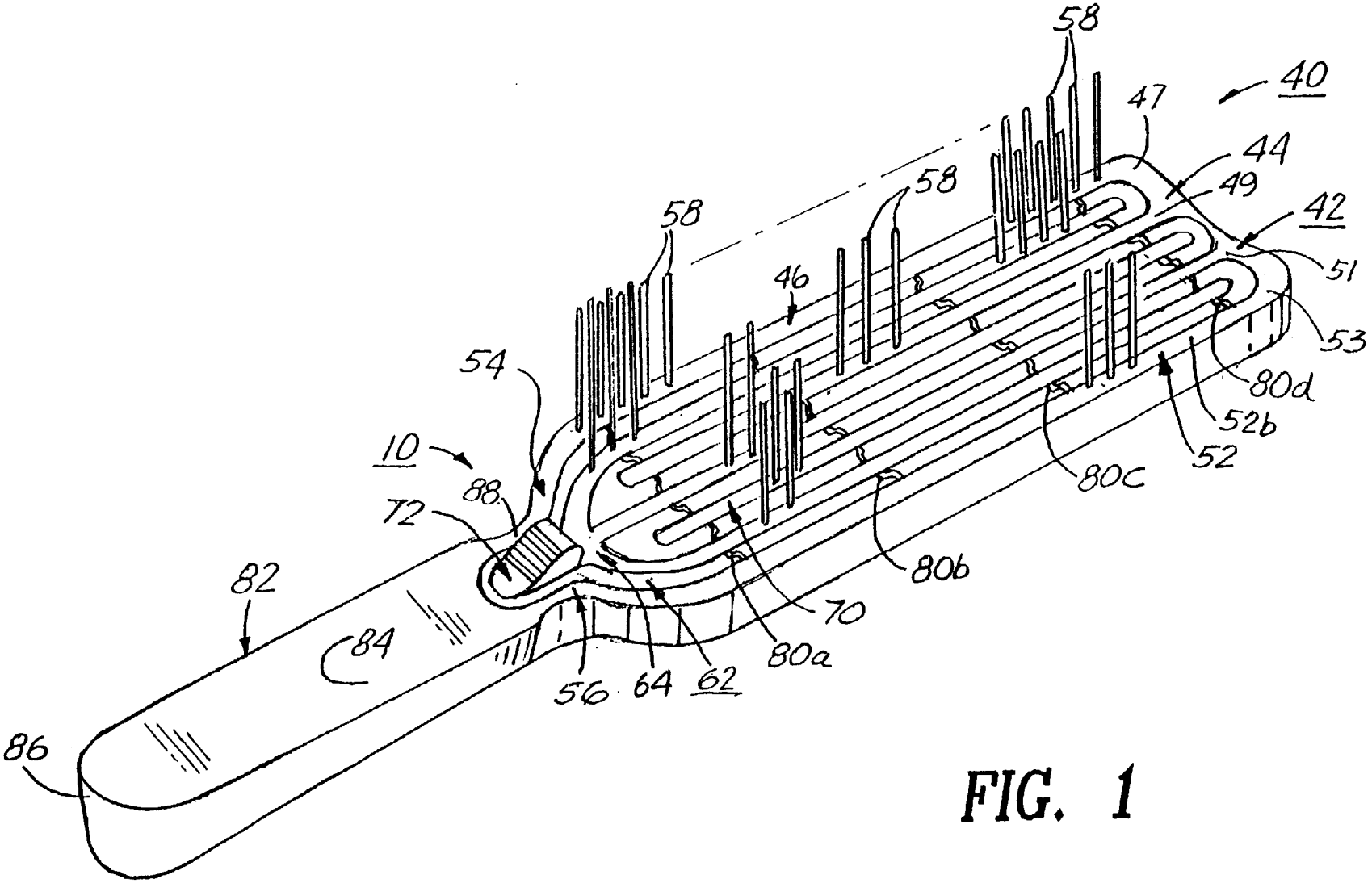
FIG. 1 is a perspective view of the hair brush of the preferred embodiment of the present invention showing the hair brush and its component parts in the first position ready for operational use.
Figures 2, 2A:
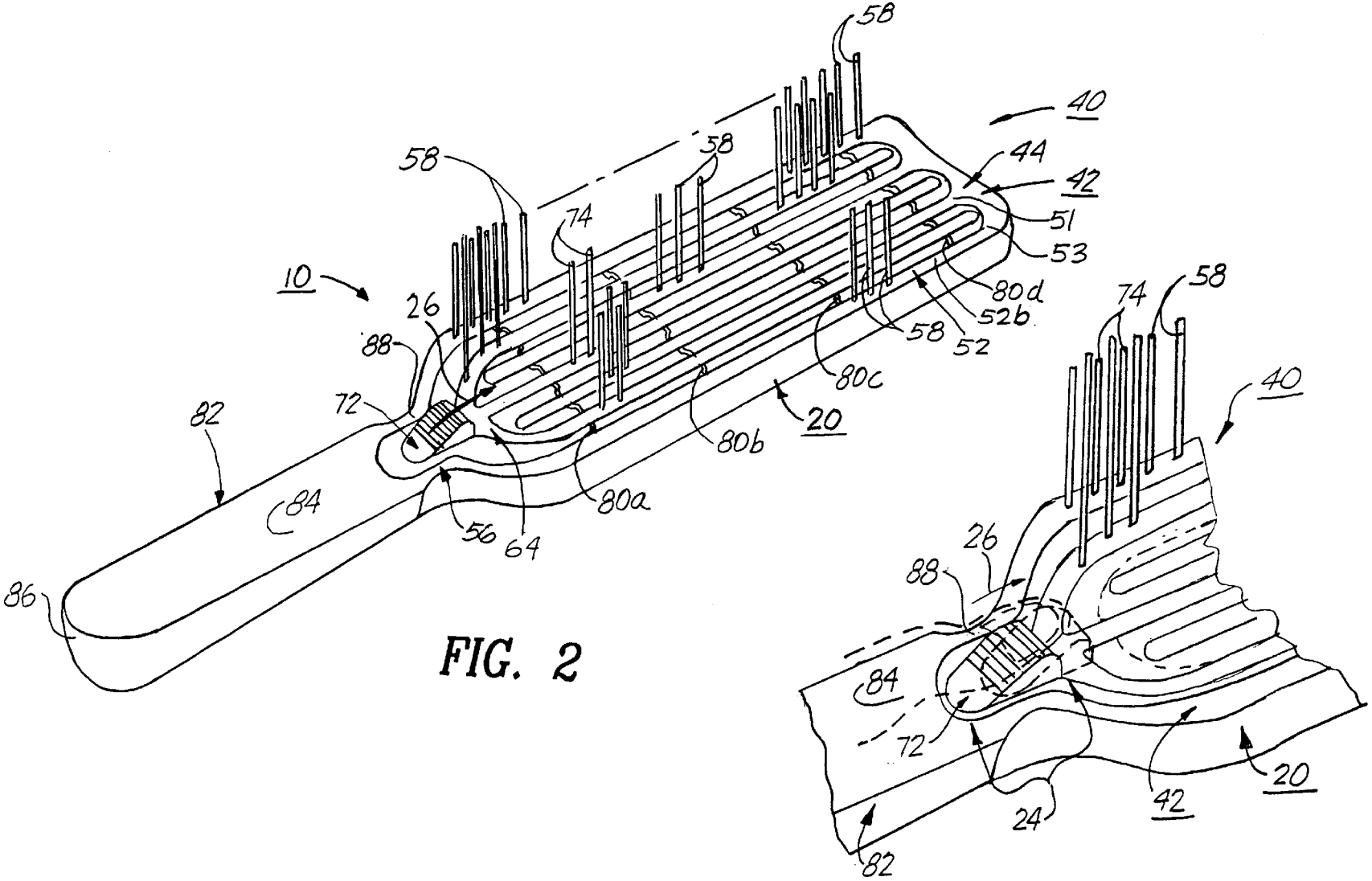
FIG. 2 is a perspective view of the hair brush of the preferred embodiment of the present invention showing the hair brush and its component parts in the second position ready for operational use.
FIG. 2A is an enlarged perspective view of the hair brush of the present invention showing the lateral movement of the push button on the handle section for moving the hair bristles laterally relative to the inner movable frame section.
Figure 3:
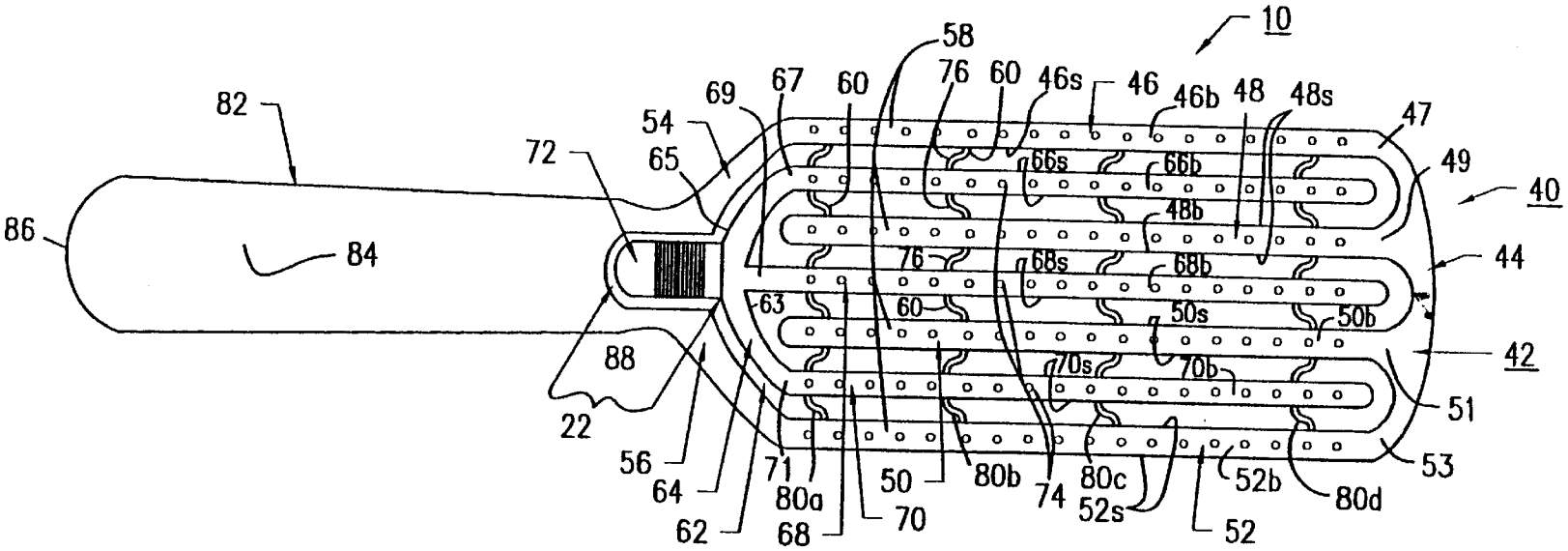
FIG. 3 is a bottom plan view of the hair brush of the present invention showing the outer stationary frame section with short bristles thereon, the inner movable frame section with long bristles thereon, the plurality of connecting springs, the push button member and the handle section.
Figure 7:
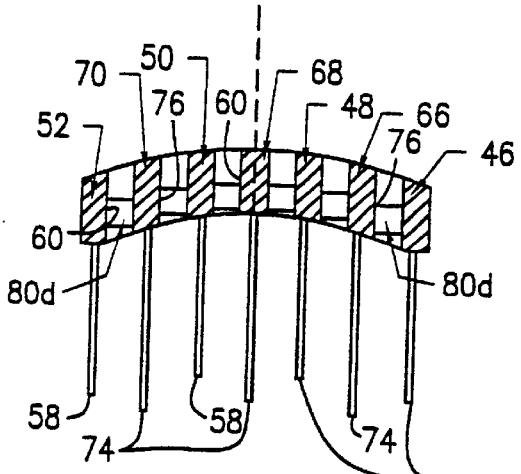
FIG. 7 is a cross-sectional view of the hair brush of the present invention taken along lines 7—7 of FIG. 4 showing the connecting spring attached to the outer stationary frame section and to the inner movable frame section.
Figure 8:
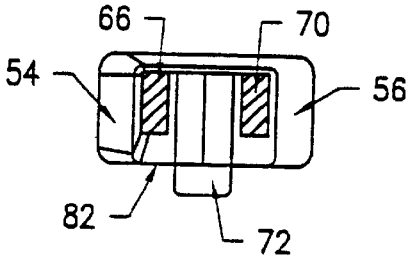
FIG. 8 is a cross-sectional view of the hair brush of the present invention taken along lines 8—8 of FIG. 4 showing the push button member attached to the inner movable frame section in relationship to the outer stationary frame member.
Figure 9:
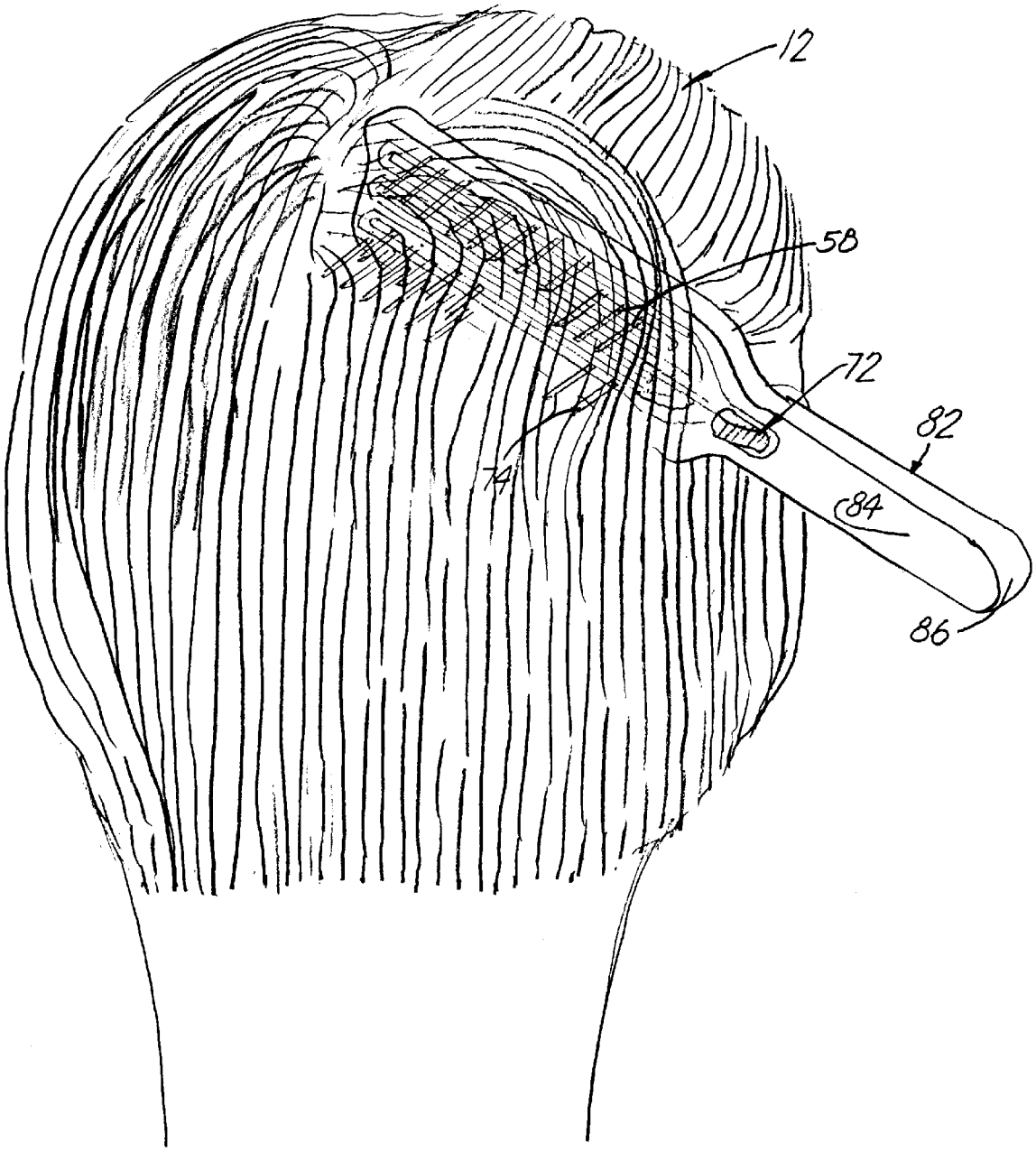
FIG. 9 is a perspective view of the hair brush of the present invention showing the hair brush in the second position and in operational use where the user's hair is laterally brushed relative to the direction of movement of the hair brush.

The hair brush 10 and its component parts of the preferred embodiment of the present invention are represented in detail by FIGS. 1 to 9 of the patent drawings. Hair brush 10 is used for multi-functional hair styling and hair grooming, such that hair brush 10 has a first position 22 and a second position 24 for giving different grooming styles to the user's hair 12 when the hair brush 10 is in operational use by the user, as shown in FIGS. 1, 2 and 9. Hair brush 10 includes a brush housing 40 having an outer stationary frame section 42, and an inner movable frame section 62, and a handle section 82 attached to one end of the brush housing 40. The inner movable frame section 62 is movably connected to the outer stationary frame section 42 by a plurality of plastic shuttle tabs, metal connecting springs or plastic connecting springs 80*a* to 80*d*, as shown in FIGS. 3 and 7 of the drawings.

Figure 4:
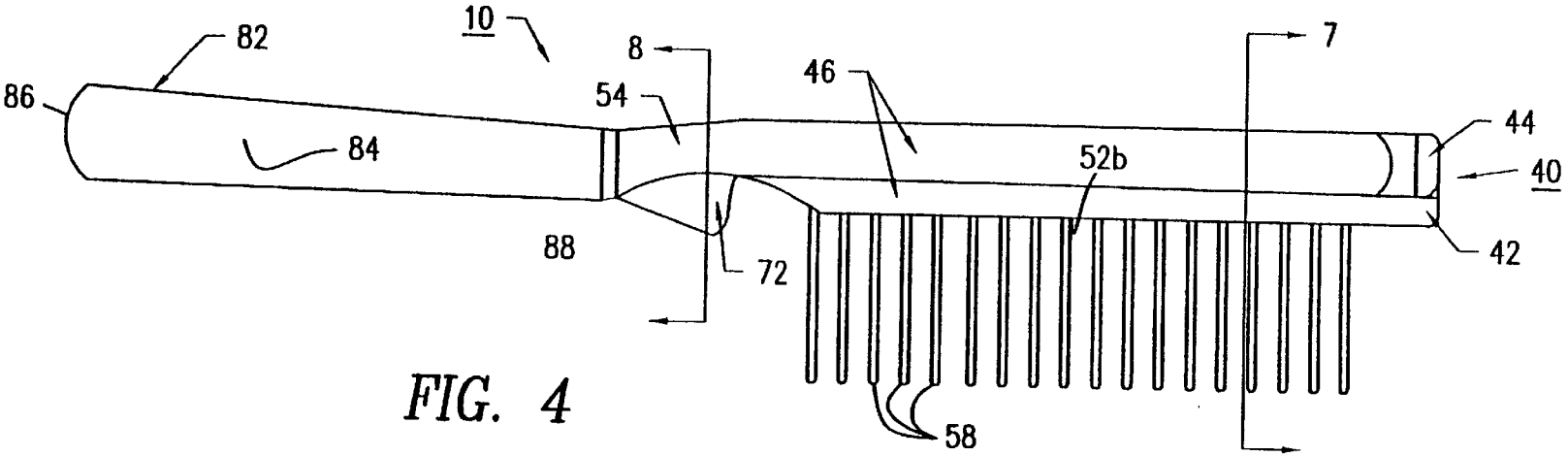
FIG. 4 is a side elevational view of the hair brush showing the outer stationary frame section with short bristles thereon, the push button member and the handle section.
Figure 5:
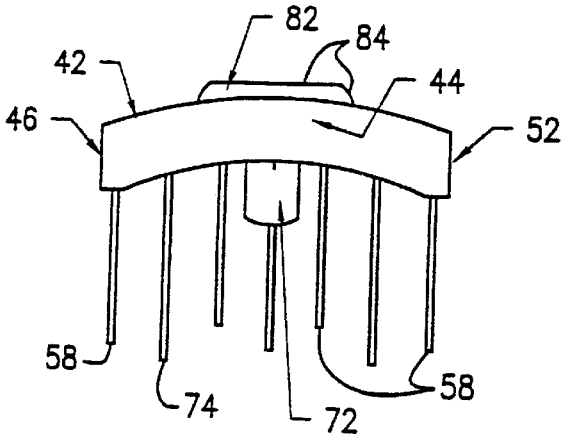
FIG. 5 is a front view of the hair brush of the present invention showing the outer stationary frame section with short bristles, the inner movable frame section with long bristles, the push button member and the handle section.
Figure 6:
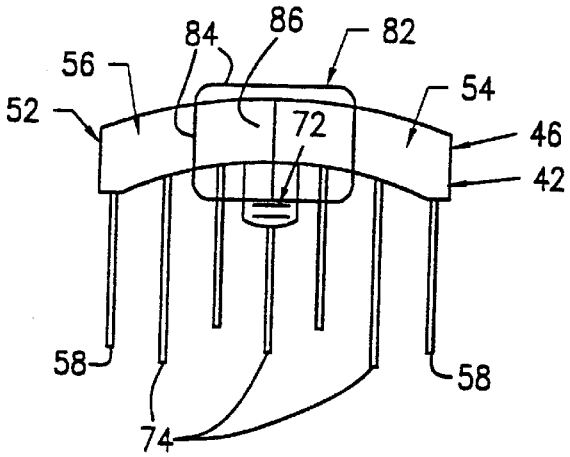
FIG. 6 is a rear view of the hair brush of the present invention showing the outer stationary frame section in short bristles, the push button member and the handle section.

The outer stationary frame section 42, as shown in FIGS. 1, 2 and 3 of the drawings, includes a front frame wall 44, a pair of outer side frame walls 46 and 52, a pair of inner frame walls 48 and 50 and a pair of inwardly tapered outer side frame walls 54 and 56. Frame walls 46, 48, 50 and 52 are equally spaced-apart from each other and are parallel with each other. Additionally, one end 47, 49, 51 and 53 of each frame wall 46 to 52 is integrally connected to the front frame wall 44, respectively, as shown in FIG. 3. Tapered frame walls 54 and 56 are integrally connected to the handle section 82, as shown in FIGS. 3 and 4 of the drawings. Each of the frame walls 46 to 52 include a plurality of short (hair) bristles 58 being equally spaced apart and located on the bottom wall surface 46*b*, 48*b*, 50*b* and 52*b*, respectively. Short bristles 58 have a preferred height of ⅞" of an inch with a height in the range of ¾" to ⅞" of an inch. Further, each of the frame walls 46 to 52 include a plurality of hole openings 60 for receiving therein the plurality of connecting springs 80*a* to 80*d*. Hole openings 60 are located on each of the side wall surfaces 46*s*, 48*s*, 50*s* and 52*s* of each of the frame walls 46 to 52, respectively.

The inner movable frame section 62, as shown in FIGS. 3 and 7 of the drawings, includes a rear inner frame wall 64, a plurality of inner frame walls 66, 68 and 70, and a slide button member 72. Inner frame walls 66 to 70 are equally spaced-apart from each other and are parallel with each other. Additionally, one end 67, 69 and 71 of each inner frame wall 66 to 70 is integrally connected to one side 63 of the rear inner frame wall 64, as shown in FIG. 3 of the drawings. Slide button member 72 is integrally connected to the other side 65 of the rear inner frame wall 64, as shown in FIGS. 3 and 8 of the drawings. Each of the inner frame walls 66 to 70 include a plurality of long (hair) bristles 74 being equally spaced-apart and located on the bottom wall surface 66*b*, 68*b* and 70*b*, respectively. Long bristles 74 have a preferred height of 1" inch with a height in range of 1" to 1⅛" inches. The difference in height between the long bristle 74 and the short bristle 58 is in the range of ⅛" of an inch to ¼" of an inch. Further, each of the inner frame walls 66 to 70 include a plurality of hole openings 76 for receiving therein the plurality of connecting springs 80*a* to 80*d*. Hole openings 76 are located on each of the side wall surfaces 66*s*, 68*s* and 70*s* of each of the inner frame walls 66 to 70, respectively.

As shown in FIG. 3 of the drawings, the inner frame walls 66, 68 and 70 of the inner movable frame section 62 are interlineated between each of the frame walls 46, 48, 50 and 52 of the outer stationary frame section 42, respectively. This interlineation of frame walls 46, 66, 48, 68, 50, 70 and 52 is such that the inner frame wall 66 is adjacent and in-between frame walls 46 and 48, the inner middle frame wall 68 is adjacent and in-between frame walls 48 and 50; and the inner frame wall 70 is adjacent and in-between frame walls 50 and 52, respectively.

Slide button member 72 is used for pushing the inner movable frame section 62 from a first position 22 to a second position 24, as shown in FIGS. 1, 2 and 3 of the patent drawings. The inner movable frame section 62 is movable between the first position 22 and the second position 24 by moving the inner movable frame section 62 in a forward direction 26 via push button member 72 which in turn moves the plurality of connecting spring members 80*a* to 80*d* forward. This moving of the inner movable frame section 62 in a forward and reverse direction 26 (connecting springs 80*a* to 80*d* are moved in a horizontal manner) relative to the outer stationary frame section 42 in the same plane, such that the long bristles 74 of frame section 62 operate to move the user's hair 12 perpendicularly relative to the direction of movement of the hair brush 10 by the user.

Handle section 82 includes a gripping portion 84 and a rounded end 86. Handle section 82 is integrally connected at one end 88 to each of the tapered frame walls 54 and 56, as shown in FIGS. 1, 3 and 4 of the drawings. The hair brush 10 can be made from a moldable polypropylene plastic in a one-step molding process.

The hair brush 10 has the following manufacturing dimensions: The overall length of hair brush 10 is 8¾" inches. The brush housing 20 has a length of (slightly over) 4½" inches, a width of 2" inches and a thickness of ⅜" of an inch with a radius of curvature ($r_c$) of 2½" inches. The handle section 82 has a length of 4¼" inches, a width of 0.90" inches and a thickness of 0.610" inches. Each of the frame walls and inner frame walls 46, 48, 50, 52, 66, 68 and 70 have a length of 3¼" inches, a width of 0.125" inches and a thickness of 0.375" inches. The short bristles 58 have a height of 0.8751" inches and the long bristles 74 have a height of 1.00" inches.

OPERATION OF THE INVENTION

In operating the hair brush 10 of the present invention, the user's first step is to simply adjust the hair brush 10 to the first position 22 or the second position 24 via the push button member 72, as shown in FIGS. 1, 2 and 9 of the patent drawings. The inner movable frame section 62 is movable between the first position 22 and the second position 24 in order to perpendicularly or laterally move the inner movable frame section 62 in a forward and rearward direction 26 relative (in the same plane) to the outer stationary frame section 42 such that the long bristles 74 operate to move the user's hair 12 laterally relative to the direction of movement of the user's hair brush 10 when in operational use by the hair stylist or self-groomer, as shown in FIG. 9 of the drawings (where hair brush 10 is in the second position 24). When the hair brush 10 is operated to move reciprocally in the first to second positions 22 and 24, the long bristles 74 are able to style and groom the user's hair 12 by brushing the lower layer 14 of the user's hair 12 to the left and right in order to cover thin, balding and/or parted hair 12.

When the hair brush 10 is set in the first position 22, the short bristles 58 are able to style and groom the user's hair 12 by brushing back the upper and lower layers 16 and 14 together (all of the layers) of the user's hair 12 in order to add more volume to the brushed hair 12 of the user.

Additionally, the short bristles 58 are also able to optionally style the user's hair 12 by brushing only the upper layer 16 of the user's hair 12 straight back without interfering with the direction of the lower layer 14 of the user's hair 12.

Hair brush 10 can be easily cleaned and washed as it is made from a durable polypropylene plastic.

ADVANTAGES OF THE PRESENT INVENTION

Accordingly, an advantage of the present invention is that it provides for a hair brush with movable bristles that is multi-functional in hair grooming and styling.

Another advantage of the present invention is that it provides for a hair brush with movable bristles, wherein the long bristles of the hair brush are movable relative to the stationary short bristles within the same hair brush.

Another advantage of the present invention is that it provides for a hair brush with movable bristles, wherein the movable long bristles being set in the moved position style the user's hair by brushing the lower layer of the user's hair to the left and right in order to cover thin, balding and/or parted hair.

Another advantage of the present invention is that it provides for a hair brush with movable bristles, wherein the stationary short bristles style the user's hair by brushing the upper layer of the user's hair straight back.

Another advantage of the present invention is that it provides for a hair brush with movable bristles, wherein the unmoved long bristles and the stationary short bristles in this first position styles the user's hair by brushing back all layers of the user's hair in order to add more volume to the brushed hair of the user.

Another advantage of the present invention is that it provides for a hair brush with movable bristles that is made from moldable polypropylene plastic in a one-step molding process.

Another advantage of the present invention is that it provides for a hair brush with movable bristles, wherein the movable bristles are used for back combing and/or teasing the hair in order to add more volume to the brushed hair of the user.

A further advantage of the present invention is that it provides for a hair brush with movable bristles that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A hair brush for multi-purpose hair styling and hair grooming, comprising:

a) a brush housing having an outer stationary frame section having a plurality of stationary parallel sections each having short bristles thereon and an inner movable frame section having a plurality of movable parallel sections each having long bristles thereon; and a handle section attached to one end of said brush housing;

b) said plurality of movable sections being interleaved with said plurality of stationary sections so that said movable sections are movable relative to said stationary sections;

c) means for movably connecting said inner movable frame section to said outer stationary frame section; and d) means for repeatedly moving said inner movable frame section between a first position and a second position to reciprocate said inner movable frame section in a forward and reverse direction relative to said outer stationary frame section so that said long bristles operate to move the user's hair perpendicular relative to said direction of movement.

2. A hair brush in accordance with claim 1, wherein said means for movably connecting said inner movable frame section to said outer stationary frame section includes a plurality of connecting springs or shuttle tabs formed of metal or plastic.

3. A hair brush in accordance with claim 1, wherein said means for moving said inner movable frame section between said first position and said second position includes a sliding member.

4. A hair brush in accordance with claim 1, wherein said short bristles have a height of ⅞" of an inch.

5. A hair brush in accordance with claim 1, wherein said short bristles have a height in the range of ¾" to ⅞" of an inch.

6. A hair brush in accordance with claim 1, wherein said long bristles have a height of 1" inch.

7. A hair brush in accordance with claim 1, wherein said long bristles have a height in the range of 1" to 1⅛" inches.

8. A hair brush in accordance with claim 1, wherein said hair brush is made from moldable polypropylene plastic in a one-step molding process.

9. A hair brush in accordance with claim 1, wherein said hair brush has an overall length of 8¾" inches.

10. A hair brush in accordance with claim 1, wherein said brush housing has a length of 4½" inches, a width of 2" inches and a thickness of ⅜" of an inch with a radius of curvature of 2½" inches.

11. A hair brush in accordance with claim 1, wherein said handle section has a length of 4¼" inches, a width of 0.900" inches and a thickness of 0.610" inches.

12. A hair brush in accordance with claim 1, wherein said plurality of stationary parallel sections include four stationary sections on said outer stationary frame section.

13. A hair brush in accordance with claim 1, wherein said plurality of movable parallel sections include three movable sections on said inner movable frame section.

14. A method of using a hair brush for multi-purpose hair styling and hair grooming, wherein the hair brush includes a brush housing having an outer stationary frame section having a plurality of stationary parallel sections each having short bristles thereon, an inner movable frame section having a plurality of movable parallel sections each having long bristles thereon, and a handle section attached to one end of the brush housing; the plurality of movable sections being interleaved with the plurality of stationary sections such that the movable sections are movable relative to the stationary sections; means for movably connecting the inner movable frame section to the outer stationary frame section; and means for repeatedly moving the inner movable frame section between a first position and a second position to reciprocate the inner movable frame section in a forward and reverse direction relative to the outer stationary frame section so that the long bristles operate to move the user's hair perpendicular relative to the direction of movement, comprising the steps of:

a) moving said movable parallel sections to said first position for moving said short bristles relative to said long bristles for styling the user's hair by brushing the upper and lower layers of the user's hair rearwardly from the forehead in order to add more volume to the brushed hair of the user; and b) repeatedly moving said long bristles on said movable parallel sections from said first position to said second position for styling the user's hair by brushing the lower layer of the user's hair to the left and right in order to cover thin, balding or parted hair.

* * * * *